US007224208B2

(12) United States Patent
Matsushita

(10) Patent No.: US 7,224,208 B2
(45) Date of Patent: May 29, 2007

(54) VOLTAGE REGULATOR WHICH OUTPUTS A PREDETERMINED DIRECT-CURRENT VOLTAGE WITH ITS EXTREME VARIATION RESTRAINED

(75) Inventor: Yuichi Matsushita, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 127 days.

(21) Appl. No.: 11/065,201

(22) Filed: Feb. 25, 2005

(65) Prior Publication Data

US 2005/0195020 A1 Sep. 8, 2005

(30) Foreign Application Priority Data

Mar. 2, 2004 (JP) ..... 2004-057714

(51) Int. Cl.
*G05F 1/10* (2006.01)

(52) U.S. Cl. ..... 327/538; 327/540; 327/541; 327/542; 327/543; 323/313; 323/326

(58) Field of Classification Search ..... None
See application file for complete search history.

(56) References Cited

U.S. PATENT DOCUMENTS 5,545,970 A * 8/1996 Parkes et al. ..... 323/277
5,578,960 A * 11/1996 Matsumura et al. ..... 327/535
5,825,234 A * 10/1998 Sung et al. ..... 327/378
5,831,471 A * 11/1998 Nakajima et al. ..... 327/540
6,281,667 B1 * 8/2001 Matsumura ..... 323/274
6,288,600 B1 * 9/2001 Kadowaki et al. ..... 327/535
6,664,773 B1 * 12/2003 Cunnac et al. ..... 323/277
6,713,992 B2 * 3/2004 Matsuo et al. ..... 323/266
6,995,588 B2 * 2/2006 Gee ..... 327/83
2001/0007517 A1 * 7/2001 Fujikawa ..... 360/67
2003/0122530 A1 * 7/2003 Hikita ..... 323/285
2003/0122630 A1 * 7/2003 Fallisgaard et al. ..... 331/158
2003/0160649 A1 * 8/2003 Nakai ..... 327/540

FOREIGN PATENT DOCUMENTS

JP 2002-189522 7/2002

* cited by examiner

*Primary Examiner*—Timothy P. Callahan
*Assistant Examiner*—Hiep Nguyen
(74) *Attorney, Agent, or Firm*—Volentine & Whitt, P.L.L.C.

(57) ABSTRACT

A voltage regulator has a reference voltage generator that outputs a reference voltage based on first and second electrical source voltages, an output circuit which generates a predetermined direct-current voltage based on the reference voltage and generates a comparison voltage lower than the predetermined direct-current voltage, and a differential amplifier coupled between the reference voltage generator and the output circuit. The differential amplifier provides a control voltage to the output circuit responsive to a difference between the reference and comparison voltages. The voltage regulator has a voltage adjustment circuit that adjusts the reference voltage responsive to a variation in the first electrical source voltage. The differential amplifier may include a constant-current circuit and an operation current generating circuit. The voltage regulator may include a detecting circuit that detects a variation in the first electrical source voltage and controls the operation current generating circuit responsive thereto.

21 Claims, 7 Drawing Sheets

VOLTAGE REGULATOR WHICH OUTPUTS A PREDETERMINED DIRECT-CURRENT VOLTAGE WITH ITS EXTREME VARIATION RESTRAINED

BACKGROUND OF THE INVENTION

1. Field of the Invention

The present invention relates to a voltage regulator which outputs a predetermined direct-current voltage and which restrains the direct-current voltage from extreme variation when a power supply voltage which is supplied to the voltage regulator is greatly changed. This is a counterpart of and claims priority to Japanese Patent Application No. 2004-57714 filed on Mar. 2, 2004, which is herein incorporated by reference.

2. Description of the Related Art

FIG. 1 is a circuit diagram for describing a voltage regulator which outputs a predetermined direct-current voltage of the related art. This voltage regulator includes a bias circuit 10 which outputs a high bias voltage Vbh and a low bias voltage Vbl, a reference voltage generator 20 which generates a reference voltage Vref based on which the predetermined direct-current voltage Vout is generated, a differential amplifier 30 and an output circuit 40 which outputs the predetermined direct-current voltage Vout and a comparison voltage Vcom.

The differential amplifier 30 outputs a control voltage Vcon based on a difference between the reference voltage Vref and the comparison voltage Vcom. The differential amplifier 30 has an N-conductive type Metal Oxide Semiconductor (hereinafter referred to as the "NMOS") transistor 31 which receives the reference voltage Vref and an NMOS transistor 32 which receives the comparison voltage Vcom. The NMOS transistor 31 has a drain electrode coupled with a first electrical source terminal T1 through a P-conductive type MOS (hereinafter referred to as the "PMOS") transistor 33. The NMOS transistor 32 has a drain electrode coupled with the first electrical source terminal T1 through a PMOS transistor 34. The NMOS transistors 31 and 32 respectively have source electrodes coupled with a node N1. An NMOS transistor 35 is coupled between the node N1 and a second electrical source terminal T2. The NMOS transistor 35 allows a constant current to pass through itself in accordance with the low bias voltage Vbl. The PMOS transistors 33 and 34 respectively have gate electrodes coupled with the drain electrode of the NMOS transistor 32. Also, the control signal Vcon is output from a node N2 which is coupled with the drain electrode of the NMOS transistor 31.

The output circuit 40 not only outputs the predetermined direct-current voltage Vout based on the control voltage Vcon but also generates the comparison voltage Vcom for the differential amplifier 30 based on the direct-current voltage Vout. The output circuit 40 includes a PMOS transistor 41 which is controlled by the control voltage Vcon, a diode-connected NMOS transistor 42 and an NMOS transistor 43 which is controlled by the low bias voltage Vbl, which are coupled in series between the first electrical source terminal T1 and the second electrical source terminal T2. The predetermined direct-current voltage Vout is output from a drain electrode of the diode-connected NMOS transistor 42, and the comparison voltage Vcom is output from a source electrode of the diode-connected NMOS transistor 42.

Details of the operations with respect to the above-mentioned voltage regulator are described below. Hereupon, for example, it is assumed that the first electrical source terminal T1 receives a first electrical source voltage V1 such as a power supply voltage Vcc and the second electrical source terminal T2 receives a second electrical source voltage V2 such as a ground voltage Vss. Furthermore, it is assumed that the power supply voltage Vcc changes in the range from 2.5V to 4.0V and the predetermined direct-current voltage Vout is 1.5V.

First of all, when the power supply voltage Vcc is 2.5V, the above-mentioned voltage regulator operates as described below.

When the reference voltage Vref (1.0V for example) output from the reference voltage generator 20 is higher than the comparison voltage Vcom from the output circuit 40, an ON-state resistance of the NMOS transistor 31 is decreased and an ON-state resistance of the NMOS transistor 32 is increased. Therefore, an electrical potential on the node N2 is decreased, that is, the control voltage Vcon which is provided to the gate electrode of the PMOS transistor 41 in the output circuit 40 is decreased. As a result, an ON-state resistance of the PMOS transistor 41 is decreased, and then, the direct-current voltage Vout and the comparison voltage Vcom are increased. On the other hand, when the reference voltage Vref is lower than the comparison voltage Vcom, the ON-state resistance of the NMOS transistor 31 is increased and the ON-state resistance of the NMOS transistor 32 is decreased. Therefore, the control voltage Vcon is increased. As a result, the ON-state resistance of the PMOS transistor 41 is increased, and then, the comparison voltage Vcom are decreased.

That is, the comparison voltage Vcom is adjusted to be equal to the reference voltage Vref by the above-mentioned feedback operation. Hereupon, for example, when the NMOS transistor 42 has a threshold voltage of 0.5V in a forward-biased direction, the predetermined direct-current voltage Vout of 1.5V is output from the output circuit 40, based on a sum of the reference voltage Vref (1.0V) and the threshold voltage (0.5V) of the NMOS transistor 42. At this time, if the PMOS transistor 41 has a threshold voltage of 0.5V in the forward-biased direction, the control voltage Vcon is substantially kept at 2.0V so that a voltage between a gate electrode and a source electrode of the PMOS transistor 41 can be substantially kept at the threshold voltage of the PMOS transistor 41.

Then, after the power supply voltage Vcc is changed from 2.5V to 4.0V, the reference voltage Vref is kept as it is and the control voltage Vcon is increased by a capacitance between the gate electrode and the source electrode of the PMOS transistor 41 responsive to the change of the power supply voltage Vcc. Therefore, the voltage between the gate electrode and the source electrode of the PMOS transistor 41 is still kept at the threshold voltage of the PMOS transistor 41. As a result, the predetermined direct-current voltage Vout and the comparison voltage Vcom are still kept at the voltages as before the change of the power supply voltage Vcc. That is, the direct-current voltage Vout is kept at the predetermined voltage without any changes before as well as after the change of the power supply voltage Vcc. Also, even when the power supply voltage V cc is decreased from 4.0V to 2.5V, the direct-current voltage Vout is kept at the predetermined voltage without any changes before as well as after the change of the power supply voltage Vcc. In addition, to keep the direct-current voltage at the predetermined voltage without an extreme change before as well as after the change of the power supply voltage Vcc, a voltage regulator has been proposed as described in Document 1 (Japanese Patent Publication Laid-open No. 2002-189522).

On the other hand, the above-mentioned voltage regulator operates as described below when the power supply voltage Vcc is changed, for example, in a greater range of 1.3V and 4.0V. When the power supply voltage Vcc is 1.3V, the reference voltage Vref is 1.0V, but the predetermined direct-current voltage Vout is 1.3V at a maximum because the predetermined direct-current voltage Vout can not exceed the power supply voltage Vcc. Accordingly, the comparison voltage Vcom does not exceed 0.8V because the threshold voltage of the NMOS transistor 42 is 0.5V. As a result, the control voltage Vcon is decreased to be an extremely low voltage (for example, 0.3V) which substantially shorts the PMOS transistor 41.

Then, after the power supply voltage Vcc is changed from 1.3V to 4.0V, the electrical potential on the node N2, that is, the control voltage Vcon is increased by the capacitance between the gate electrode and the source electrode of the PMOS transistor 41 responsive to the change of the power supply voltage Vcc. Since the PMOS transistor 41 is substantially shorted as stated above, the increase of the control voltage Vcon can not increase an ON-state resistance of the PMOS transistor 41. Therefore, the direct-current voltage Vout is increased by exceeding the predetermined voltage of 1.5V responsive to the great increase of the power supply voltage Vcc. After that, the direct-current voltage Vout is steadied down to the predetermined voltage of 1.5V.

In order to adjust to the above-mentioned change of the power supply voltage Vcc, it is necessary to allow a large current to pass through the differential amplifier 30. However, in the voltage regulator which realizes low power consumption, the great change of the power supply voltage Vcc generates an extreme variation of the direct-current voltage Vout by which the direct-current voltage Vout largely exceeds the predetermined voltage.

SUMMARY OF THE INVENTION

An object of the present invention is to restrain the direct-current voltage from varying extremely when the first electrical source voltage such as the power supply voltage which is supplied to the voltage regulator is greatly changed.

According to an aspect of the present invention, for achieving the above-mentioned object there is provided a voltage regulator which generates a predetermined direct-current voltage and which includes a reference voltage generator that is coupled between a first electrical source terminal which receives a first electrical source voltage and a second electrical source terminal which receives a second electrical source voltage which is lower than the first electrical source voltage. The reference voltage generator outputs a reference voltage based on the first and second electrical source voltages. The voltage regulator further includes an output circuit that is coupled between the first electrical source terminal and the second electrical source terminal and a differential amplifier that is coupled between the reference voltage generator and the output circuit. The output circuit generates the predetermined direct-current voltage based on the reference voltage and generates a comparison voltage lower than the predetermined direct-current voltage. The differential amplifier provides a control voltage to the output circuit responsive to a difference between the reference voltage and the comparison voltage. The voltage regulator still further includes a voltage adjustment circuit that is coupled to the reference voltage generator and the differential amplifier. The voltage adjustment circuit adjusts the reference voltage responsive to a variation in the first electrical source voltage.

According to another aspect of the present invention, for achieving the above object, there is provided a voltage regulator which generates a predetermined direct-current voltage and which includes a reference voltage generator that is coupled between a first electrical source terminal which receives a first electrical source voltage and a second electrical source terminal which receives a second electrical source voltage which is lower than the first electrical source voltage. The reference voltage generator outputs a reference voltage based on the first and second electrical source voltages. The voltage regulator further includes an output circuit that is coupled between the first electrical source terminal and the second electrical source terminal, and a differential amplifier that is coupled between the reference voltage generator and the output circuit. The output circuit generates the predetermined direct-current voltage based on the reference voltage and generates a comparison voltage lower than the predetermined direct-current voltage. The differential amplifier includes an operation current generating circuit. The differential amplifier provides a control voltage to the output circuit responsive to a difference between the reference voltage and the comparison voltage. The voltage regulator still further includes a detecting circuit that is coupled between the first electrical source terminal and the second electrical source terminal. The detecting circuit detects a variation in the first electrical source voltage and controls the operation current generating circuit responsive to the detected variation.

The above and further objects and novel features of the invention will more fully appear from the following detailed description, appended claims and the accompanying drawings.

DETAILED DESCRIPTION OF THE PREFERRED EMBODIMENTS

The present invention will be described hereinafter with references to the accompanying drawings. The drawings used for this description typically illustrate major characteristic parts in order that the present invention will be easily understood.

Figure 1:
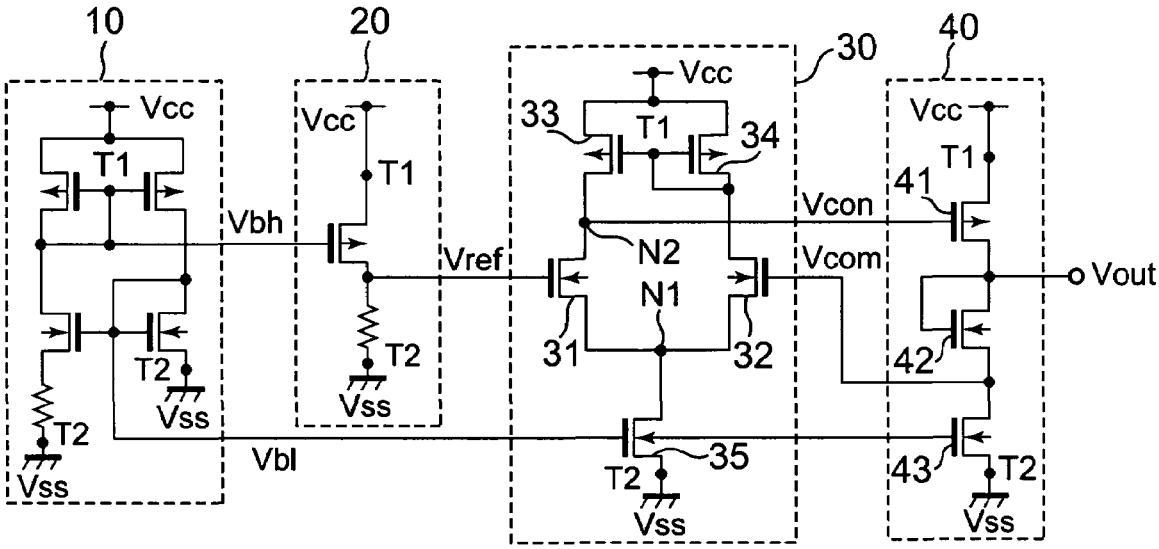
PRIOR ART Fig. 1
FIG. 1 is a circuit diagram for describing a voltage regulator of the related art.
Figure 2:
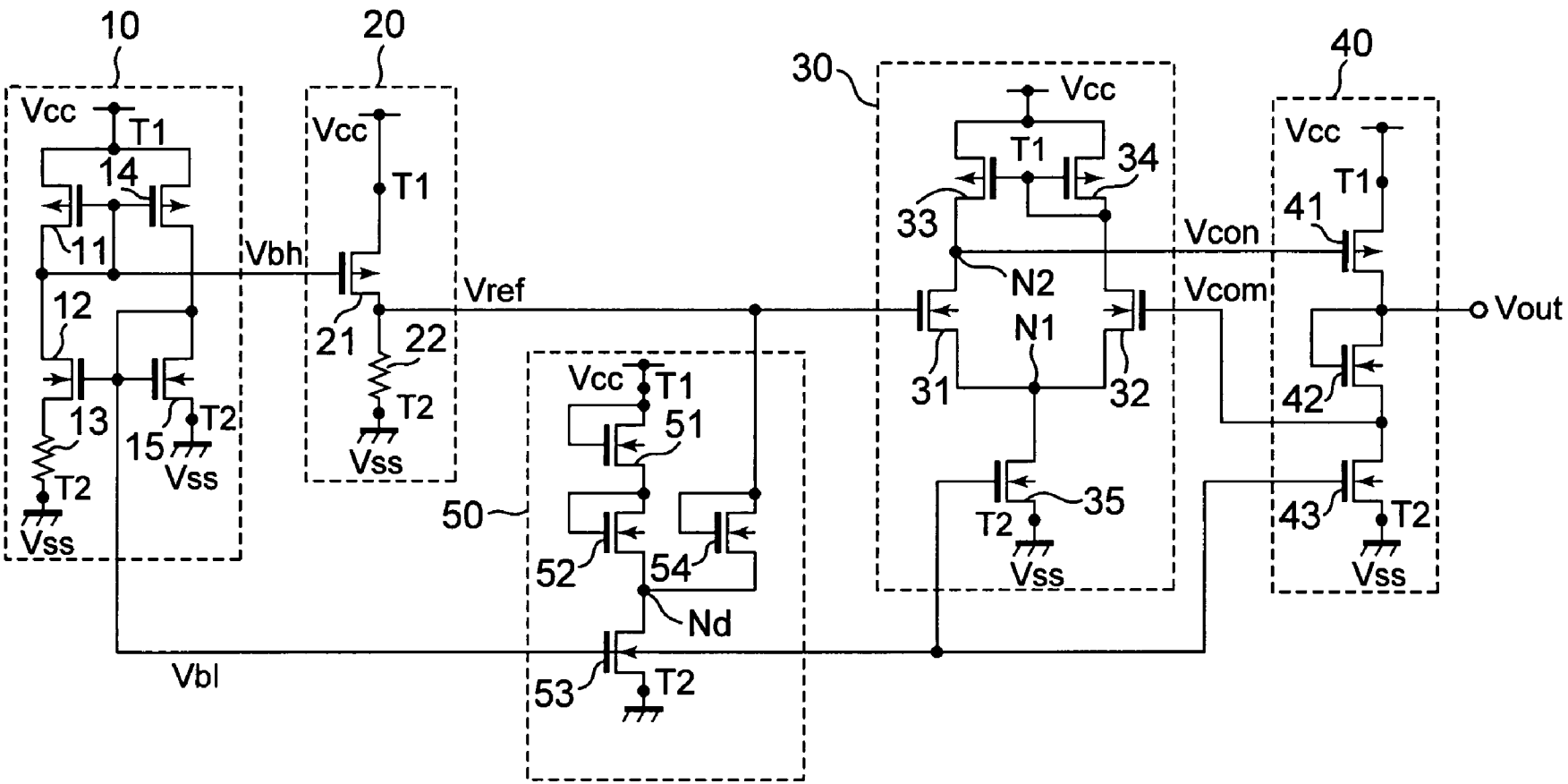
FIG. 2 is a circuit diagram for describing a voltage regulator according to a first preferred embodiment of the present invention.

FIG. 2 is a circuit diagram for describing a voltage regulator which outputs a direct-current voltage according to a first preferred embodiment of the present invention. This voltage regulator includes a bias voltage generator 10 which outputs a high bias voltage Vbh and a low bias voltage Vbl, a reference voltage generator 20 which generates a reference voltage Vref based on which the predetermined direct-current voltage Vout is generated, a differential amplifier 30, an output circuit 40 which outputs the predetermined direct-current voltage Vout and a comparison voltage Vcom, and a voltage adjusting circuit 50 which adjusts the reference voltage Vref. Each of the bias voltage generator 10, the reference voltage generator 20, the differential amplifier 30, the output circuit 40 and the voltage adjusting circuit 50 is coupled between a first electrical source terminal T1 and a second electrical source terminal T2. Hereupon, for example, the first electrical source terminal T1 receives a first electrical source voltage V1 such as a power supply voltage Vcc, and the second electrical source terminal T2 receives a second electrical source voltage V2 such as a ground voltage Vss which is lower than the first electrical source voltage.

The bias voltage generator 10 generates the high bias voltage Vbh for the reference voltage generator 20 and the low bias voltage Vbl for the differential amplifier 30, the output circuit 40 and the voltage adjusting circuit 50. The high bias voltage Vbh is higher than the low bias voltage Vbl and allows a constant current to pass through the reference voltage generator 20 even if the power supply voltage Vcc varies. The bias voltage generator 10 has a PMOS transistor 11, an NMOS transistor 12 and a resistance element 13 coupled in series between the first electrical source terminal T1 and the second electrical source terminal T2, and also has a PMOS transistor 14 and an NMOS transistor 15 coupled in series between the first electrical source terminal T1 and the second electrical source terminal T2. The PMOS transistor 11 has a gate electrode and a drain electrode coupled to a gate electrode of the PMOS transistor 14. That is, the PMOS transistors 11 and 14 constitute a first current mirror circuit. The PMOS transistor 14 has a source electrode coupled to the first electrical source terminal T1. The NMOS transistor 15 has a gate electrode and a drain electrode coupled to a gate electrode of the NMOS transistor 13 and a drain electrode of the PMOS transistor 14. That is, the NMOS transistors 13 and 15 constitute a second current mirror circuit. The NMOS transistor 15 has a source electrode coupled to the second electrical source terminal T2. The high bias voltage Vbh is output from the drain electrode of the PMOS transistor 11, and the low bias voltage Vbl is output from the drain electrode of the NMOS transistor 15.

The reference voltage generator 20 is coupled to the bias voltage generator 10 in order to receive the high bias voltage Vbh. The reference voltage generator 20 has a PMOS transistor and a resistance element 22 coupled in series between the first electrical terminal T1 and the second electrical source terminal T2. The PMOS transistor 21 has a source electrode coupled to the first electrical source terminal T1, a drain electrode coupled to the resistance element 22 and a gate electrode coupled to the bias voltage generator 10 to receive the high bias voltage Vbh. The reference voltage Vref is generated from the drain electrode of the PMOS transistor 21.

The differential amplifier 30 provides a control voltage Vcon to the output circuit 40 responsive to a difference between the reference voltage Vref and the comparison voltage Vcom. The differential amplifier 30 has NMOS transistors 31 and 32 coupled in parallel between the first electrical source terminal T1 and a first node N1. The NMOS transistor 31 has a gate electrode which receives the reference voltage Vref, a drain electrode coupled to the first electrical source terminal T1 through a PMOS transistor 33, and a source electrode coupled to the first node N1. The NMOS transistor 32 has a gate electrode which receives the comparison voltage Vcom, a drain electrode coupled to the first electrical source terminal T1 through a PMOS transistor 34, and a source electrode coupled to the first node N1. Also, the differential amplifier 30 has a constant-current circuit which consists of an NMOS transistor 35 coupled between the first node N1 and the second electrical source terminal T2. The NMOS transistor 35 is controlled by the low bias voltage Vbl and then allows a constant current to pass through itself. The PMOS transistors 33 and 34 respectively have gate electrodes coupled with the drain electrode of the NMOS transistor 32. Also, the control signal Vcon is output from a node N2 which is coupled with the drain electrode of the NMOS transistor 31.

The output circuit 40 not only outputs the predetermined direct-current voltage Vout based on the reference voltage Vref responsive to the control voltage Vcon, but also outputs the comparison voltage Vcom to the differential amplifier 30 based on the predetermined direct-current voltage Vout as feedback. The output circuit 40 includes a first output MOS transistor 41 which is controlled by the control voltage Vcon, a second output MOS transistor 42 which is diode-connected and a third output MOS transistor 43 which is controlled by the low bias voltage Vbl, which are coupled in series between the power supply voltage terminal T1 and the ground voltage terminal T2. In this example, the first output MOS transistor 41 is a P-type conductive MOS transistor, and the second and third output MOS transistors 42 and 43 are N-type conductive MOS transistors. The predetermined direct-current voltage Vout is output from a drain electrode of the second output MOS transistor 42, and the comparison voltage Vcom is output from a source electrode of the second output MOS transistor 42.

The voltage adjustment circuit 50 adjusts the reference voltage Vref to be substantially equal to the comparison voltage Vcom when the first electrical source voltage V1 (hereupon, for example, the power supply voltage Vcc) is lower than the predetermined direct-current voltage Vout. The voltage adjustment circuit 50 has first and second adjusting MOS transistors 51 and 52 coupled in series between the first electrical source terminal T1 and a voltage dividing node Nd. The first and second adjusting NMOS transistors 51 and 52 are diode-connected NMOS transistors. Also, the voltage adjustment circuit 50 has a third adjusting NMOS transistor 53 coupled between the voltage dividing node Nd and the second electrical source terminal T2. The third adjusting NMOS transistor 53 is controlled by the low bias voltage Vbl. Furthermore, the voltage adjustment circuit 50 has a fourth adjusting NMOS transistor 54 coupled between the reference voltage generator 20 and the voltage dividing node Nd. The fourth adjusting NMOS transistor 54 is a diode-connected NMOS transistor. Hereupon, a ratio of a gate width to a gate length of each of the first to fourth adjusting NMOS transistors 51-54 is determined so that a current passing through the voltage adjustment circuit 50 is larger than a current passing through the reference voltage generator 20. That is, the ratio of the gate width to the gate length of the second adjusting NMOS transistor 52 is the same as the ratio of the gate width to the gate length of the fourth adjusting NMOS transistor 54. Also, the ratio of the gate width to the gate length of the first adjusting NMOS transistor is the same as a ratio of a gate width to a gate length of the second output MOS transistor 42. Furthermore, the ratio of the gate width to the gate length of the third adjusting NMOS transistor 53 is the same as a ratio of a gate width to a gate length of the third output MOS transistor 43. In addition, the first adjusting NMOS transistor 51 may have the same volt-ampere characteristic as the second output MOS transistor 42, and the third adjusting NMOS transistor 53 may have the same volt-ampere characteristic as the third output MOS transistor 43. Additionally, the first adjusting NMOS transistor 51 may have the same pattern of layout as the second output MOS transistor 42, and the third adjusting NMOS transistor 53 may have the same pattern of layout as the third output MOS transistor 43.

Figure 3:
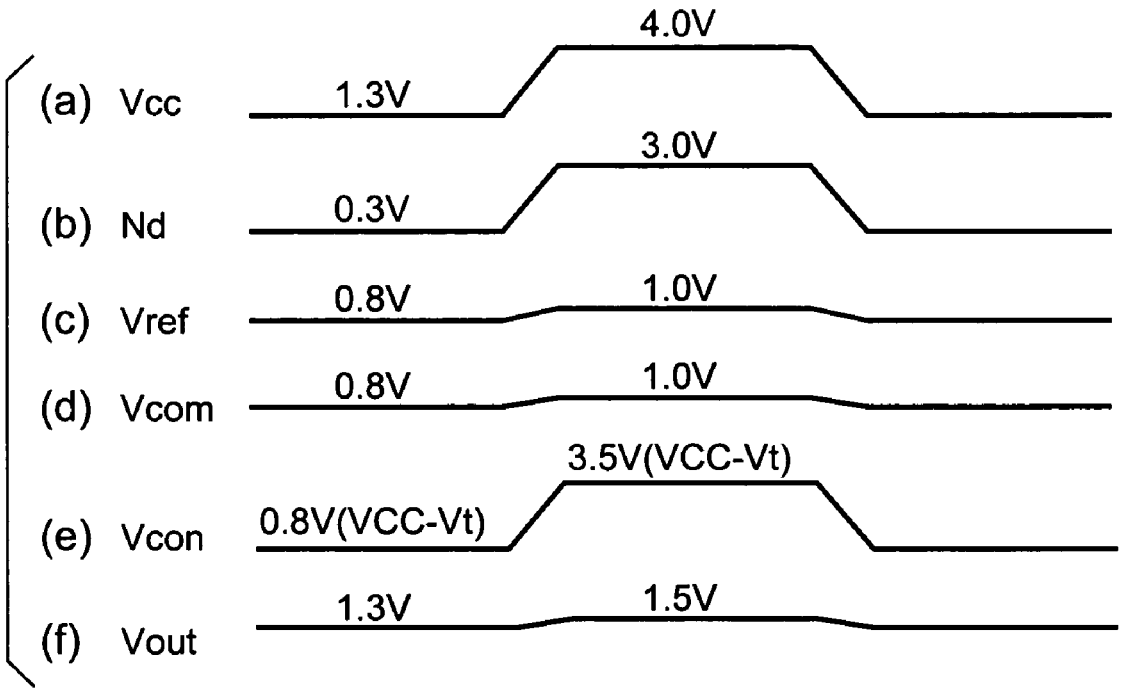
FIGS. 3(*a*) through 3(*f*) are signal waveform diagrams for describing the operation of the voltage regulator in FIG. 2.

The operation of the voltage regulator according to the first preferred embodiment of the present invention is described below. FIGS. 3(*a*) through 3(*f*) are signal waveform diagrams for describing the operation of the voltage regulator in FIG. 2. FIG. 3(*a*) represents a waveform of the power supply voltage Vcc, FIG. 3(*b*) represents a waveform of an electrical potential on the voltage dividing node Nd, FIG. 3(*c*) represents a waveform of the reference voltage Vref, FIG. 3(*d*) represents a waveform of the comparison voltage Vcom, FIG. 3(*e*) represents a waveform of the control voltage Vcon and FIG. 3(*f*) represents a waveform of the direct-current voltage Vout. Hereupon, for example, it is assumed that the predetermined direct-current voltage Vout is 1.5V and a threshold voltage Vt of each of the PMOS and NMOS transistors as shown in FIG. 2 is 0.5V.

When the power supply voltage Vcc is 1.3V and thus lower than the predetermined direct-current voltage Vout (1.5V), the voltage regulator according to the first preferred embodiment operates as described below. First of all, when the power supply voltage Vcc is 1.3V as shown in FIG. 3(*a*), the direct-current voltage Vout output from the output circuit 40 is 1.3V at a maximum as shown in FIG. 3(*f*). Therefore, the comparison voltage Vcom is 0.8V because of the threshold voltage Vt (0.5V) of the second output MOS transistor 42 as shown in FIG. 3(*d*). For the meantime, in the voltage adjustment circuit 50, the electrical potential on the voltage dividing node Nd is 0.3V which is 1.0V lower than the power supply voltage Vcc (1.3V) as shown in FIG. 3(*b*), because of the threshold voltages Vt of the first and second adjusting NMOS transistors 51 and 52. Also, the drain electrode of the PMOS transistor 21 from which the reference voltage Vref is output is coupled to the voltage dividing node Nd of the voltage adjustment circuit 50 through the fourth adjusting NMOS transistor 54 and the current passing through the voltage adjustment circuit 50 is larger than the current passing through the reference voltage generator 20 as stated above. Therefore, the reference voltage Vref is decreased to 0.8V as shown in FIG. 3(*c*). In this way, the reference voltage Vref is substantially equal to the comparison voltage Vcom. That is, a current passing through the NMOS transistor 31 and the PMOS transistor 33 becomes substantially equal to a current passing through the NMOS transistor 32 and the PMOS transistor 34. Since the threshold voltage Vt of the PMOS transistor 34 is 0.5V as stated above, an electrical potential on the drain electrode of the NMOS transistor 32 is 0.8V which is 0.5V lower than the power supply voltage Vcc (1.3V). Furthermore, since the PMOS transistors 33 and 34 constitutes a current mirror circuit and the threshold voltage Vt of the PMOS transistor 33 is 0.5V, the control voltage Vcon is 0.8V which is 0.5V lower than the power supply voltage Vcc (1.3V) so that a difference between the control voltage Vcon and the power supply voltage Vcc is substantially kept at the threshold voltage Vt of the first output MOS transistor 41 of the output circuit 40 as shown in FIG. 3(*e*). That is, at this time, an ON-state resistance of the first output MOS transistor 41 is ensured so that the first output MOS transistor 41 is not shorted.

Then, after the power supply voltage Vcc is increased from 1.3V to 4.0V, the electrical potential on the voltage dividing node Nd is increased from 0.3V to 3.OV because of the threshold voltages Vt of the first and second adjusting NMOS transistors 51 and 52 as shown in FIG. 3(*b*). The reference voltage Vref is also increased from 0.8V to 1.0V as shown in FIG. 3(*c*). That is, the electrical potential on the voltage dividing node Nd exceeds the reference voltage Vref. Therefore, the fourth adjusting NMOS transistor 54 is turned OFF, and thus, the reference voltage Vref is kept in 1.0V. On the other hand, the control voltage Vcon, the direct-current voltage Vout and the comparison voltage Vcom begin to increase responsive to the increase of the power supply voltage Vcc. Then, the comparison voltage Vcom is adjusted to be substantially equal to the reference voltage Vref (1.0V) by a feedback operation between the differential amplifier 30 and the output circuit 40 as shown in FIG. 3(*d*). Therefore, the direct-current voltage Vout is kept in the predetermined voltage of 1.5V which is higher than the comparison voltage Vcom (1.0V), that is, the reference voltage Vref (1.0V) by the threshold voltage Vt (0.5V) of the second output MOS transistor 42 as shown in FIG. 3(*f*). Also, the control voltage Vcon is kept in 3.5V which is lower than the power supply voltage Vcc (4.0V) by the threshold voltage Vt (0.5V) of the PMOS transistor 33 because of the operation of the differential amplifier 30 as shown in FIG. 3(*e*). Therefore, the difference between the control voltage Vcon and the power supply voltage Vcc is substantially kept to be the threshold voltage Vt of the first output MOS transistor 41. That is, even after the increase of the power supply voltage Vcc, the ON-state resistance of the first output MOS transistor 41 is still ensured so that the first output MOS transistor 41 is not shorted as well as before the increase of the power supply voltage Vcc. As a result, the first output MOS transistor 41 does not allow an excessive current to pass through itself responsive to the great increase of the power supply voltage Vcc. Accordingly, the direct-current voltage Vout is steadied down to the predetermined voltage of 1.5V with the extreme increase of the direct-current voltage Vout restrained as shown in FIG. 3(*f*).

In addition, in the above mentioned first preferred embodiment, diode-connected PMOS transistors or diodes may be used instead of the diode-connected NMOS transistors 42, 51, 52 and 54. Also, NMOS transistors whose gate electrodes are coupled to the first electrical source terminal T1, PMOS transistors whose gate electrodes are coupled to the second electrical source terminal T2 or resistance elements may be used instead of the NMOS transistor 35, 43 and 53 used as constant-current circuits.

According to the first preferred embodiment, the voltage adjustment circuit adjusts the reference voltage to be substantially equal to the comparison voltage when the first electrical source voltage such as the power supply voltage is lower than the predetermined direct-current voltage. That is, the ON-state resistance of the first output MOS transistor is ensured so that the first output MOS transistor is not shorted when the first electrical source voltage is lower than the predetermined direct-current voltage. Therefore, even after the first electrical source voltage is extremely increased, the ON-state resistance of the first output MOS transistor is still ensured so that the first output MOS transistor is not shorted. As a result, the extreme increase of the direct-current voltage can be restrained before the direct-current voltage is steadied down to the predetermined voltage.

Figure 4:
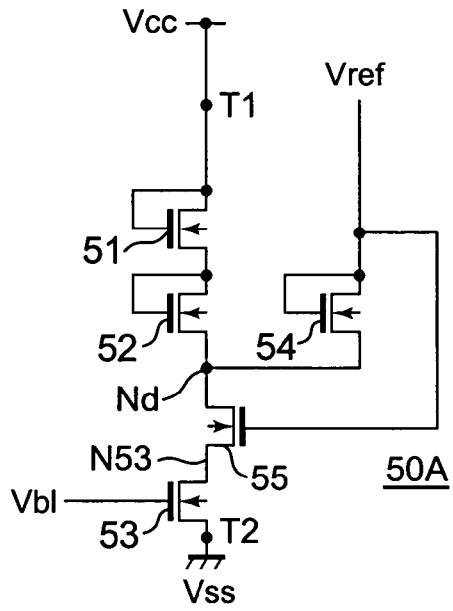
FIG. 4 is a circuit diagram for describing a voltage adjustment circuit according to a second preferred embodiment of the present invention.

FIG. 4 is a circuit diagram for describing a voltage adjustment circuit 50A according to a second preferred embodiment of the present invention. In the voltage regulator according to the second preferred embodiment, the voltage adjustment circuit 50A is used instead of the voltage adjustment circuit 50 in the voltage regulator according to first preferred embodiment.

The voltage adjustment circuit 50A has the first to fourth adjusting NMOS transistors 51–54 as well as the voltage adjustment circuit 50 in the first preferred embodiment. The voltage adjustment circuit 50A also has a fifth adjusting NMOS transistor 55 coupled between the voltage dividing node Nd and a drain electrode of the third adjusting NMOS transistor 53. The fifth adjusting NMOS transistor 55 has a gate electrode coupled to the reference voltage generator 20 so as to receive the reference voltage Vref. Hereupon, for example, it is assumed that a threshold voltage Vt of the fifth adjusting NMOS transistor is 0.5V. Also, a withstand voltage of the fifth adjusting NMOS transistor 55 may be greater than a withstand voltage of the third adjusting NMOS transistor 53.

Figure 5:
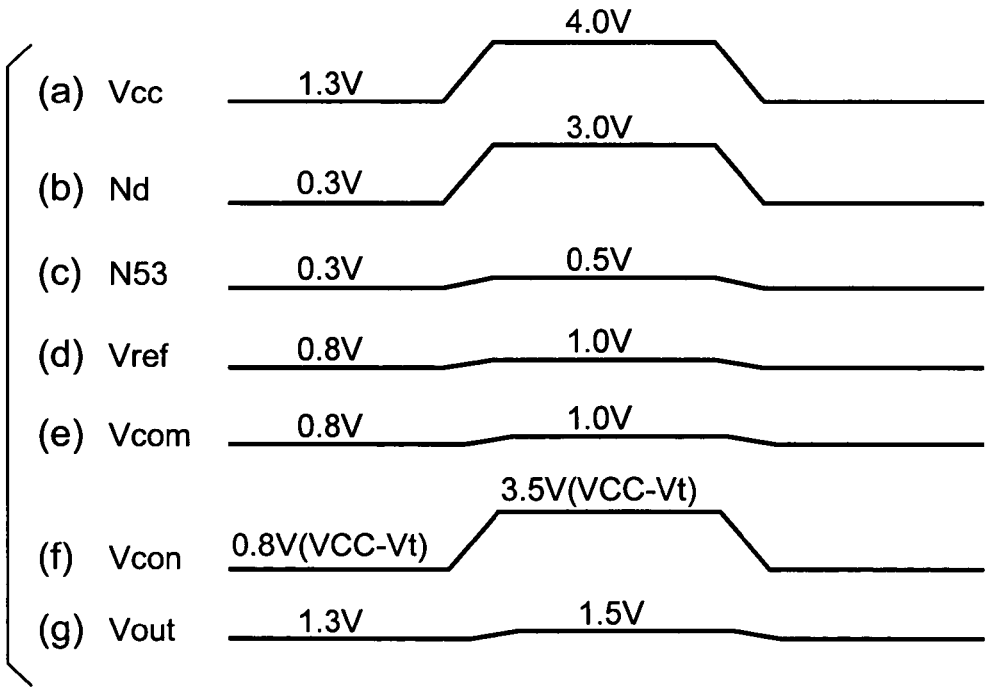
FIGS. 5(*a*) through 5(*g*) are signal waveform diagrams for describing the operation of the voltage regulator in FIG. 4.

The operation of the voltage regulator according to the second preferred embodiment of the present invention is described below. FIGS. 5(*a*) through 5(*g*) are signal waveform diagrams for describing the operation of the voltage regulator in FIG. 4. FIG. 5(*a*) represents a waveform of the power supply voltage Vcc, FIG. 5(*b*) represents a waveform of an electrical potential on the voltage dividing node Nd, FIG. 5(*c*) represents a waveform of an electrical potential on the drain electrode N53 of the third adjusting NMOS transistor 53, FIG. 5(*d*) represents a waveform of the reference voltage Vref, FIG. 5(*e*) represents a waveform of the comparison voltage Vcom, FIG. 5(*f*) represents a waveform of the control voltage Vcon and FIG. 5(*g*) represents a waveform of the direct-current voltage Vout.

When the power supply voltage Vcc is 1.3V and thus lower than the desired direct-current voltage Vout (1.5V) as shown in FIG. 5(*a*), the direct-current voltage Vout is 1.3V at a maximum as shown in FIG. 5(*g*). Therefore, as shown in FIG. 5(*e*), the comparison voltage Vcom is 0.8V as well as in the first preferred embodiment. For the meantime, in the voltage adjustment circuit 50A, the electrical potential on the voltage dividing node Nd is 0.3V which is 1.0V lower than the power supply voltage Vcc (1.3V) as well as in the first preferred embodiment. Hereupon, the reference voltage Vref is initially 1.0V. Therefore, the fifth adjusting NMOS transistor 55 is turned ON and the electrical potential on the drain electrode N53 of the third adjusting NMOS transistor 53 is 0.3V. Then, as shown in FIG. 5(*d*), the reference voltage Vref is decreased to 0.8V by the voltage adjustment circuit 50A as well as in the first preferred embodiment. After the reference voltage Vref is substantially equal to the comparison voltage Vcom, the control voltage Vcon is 0.8V which is 0.5V lower than the power supply voltage Vcc (1.3V) so that the difference between the control voltage Vcon and the power supply voltage Vcc is substantially kept at the threshold voltage Vt of the first output MOS transistor 41 of the output circuit 40 as shown in FIG. 5(*f*). That is, at this time, the ON-state resistance of the first output MOS transistor 41 is ensured so that the first output MOS transistor 41 is not shorted.

Then, after the power supply voltage Vcc is increased from 1.3V to 4.0V, the electrical potential on the voltage dividing node Nd is increased from 0.3V to 3.0V as shown in FIG. 5(*b*) and the reference voltage Vref is also increased from 0.8V to 1.0V as shown in FIG. 5(*d*). That is, the electrical potential on the voltage dividing node Nd exceeds the reference voltage Vref. Therefore, the fourth adjusting NMOS transistor 54 is turned OFF, and thus, the reference voltage Vref is kept in 1.0V. Since the fifth adjusting NMOS transistor 55 is turned OFF at this time, the electrical potential on the drain electrode N53 of the third adjusting NMOS transistor 53 is 0.5V which is lower than the reference voltage Vref by the threshold voltage Vt (0.5V) of the NMOS transistor 55. As a result, a voltage applied across the third adjusting NMOS transistor 53 is 0.5 at a maximum. That is, the voltage applied across the third adjusting NMOS transistor 53 can be further reduced as compared with that in the first preferred embodiment.

On the other hand, the control voltage Vcon, the direct-current voltage Vout and the comparison voltage Vcom begin to increase responsive to the increase of the power supply voltage Vcc. Then, the comparison voltage Vcom is adjusted to be substantially equal to the reference voltage Vref (1.0V) by a feedback operation between the differential amplifier 30 and the output circuit 40 as shown in FIG. 5(*e*). Therefore, the direct-current voltage Vout is kept in the predetermined voltage of 1.5V which is higher than the comparison voltage Vcom (1.0V), that is, the reference voltage Vref (1.0V) by the threshold voltage Vt (0.5V) of the second output MOS transistor 42 as shown in FIG. 5(*g*). Also, the control voltage Vcon is kept at 3.5V which is lower than the power supply voltage Vcc (4.0V) by the threshold voltage Vt (0.5V) of the PMOS transistor 33 because of the operation of the differential amplifier 30 as shown in FIG. 5(*f*). Therefore, the difference between the control voltage Vcon and the power supply voltage Vcc is substantially kept to be the threshold voltage Vt of the first output MOS transistor 41. That is, even after the increase of the power supply voltage Vcc, the ON-state resistance of the first output MOS transistor 41 is still ensured so that the first output MOS transistor 41 is not shorted as well as before the increase of the power supply voltage Vcc. As a result, the first output MOS transistor 41 does not allow an excessive current to pass through itself responsive to the great increase of the power supply voltage Vcc. Accordingly, the direct-current voltage Vout is steadied down to the predetermined voltage of 1.5V with the extreme increase of the direct-current voltage Vout restrained as shown in FIG. 5(*g*).

According to the second preferred embodiment, the voltage adjustment circuit has a fifth adjusting NMOS transistor coupled between the voltage dividing node and the drain electrode of the third adjusting NMOS transistor, and the fifth adjusting NMOS transistor is controlled by the reference voltage. Therefore, in addition to the effects realized in the first preferred embodiment, the voltage applied across the third adjusting NMOS transistor can be reduced in the second preferred embodiment. As a result, it is not necessary that a withstand voltage of the third adjusting NMOS transistor is great. That is, the voltage regulator can be manufactured in a process by which transistors having lower withstand voltages are manufactured.

Figure 6:
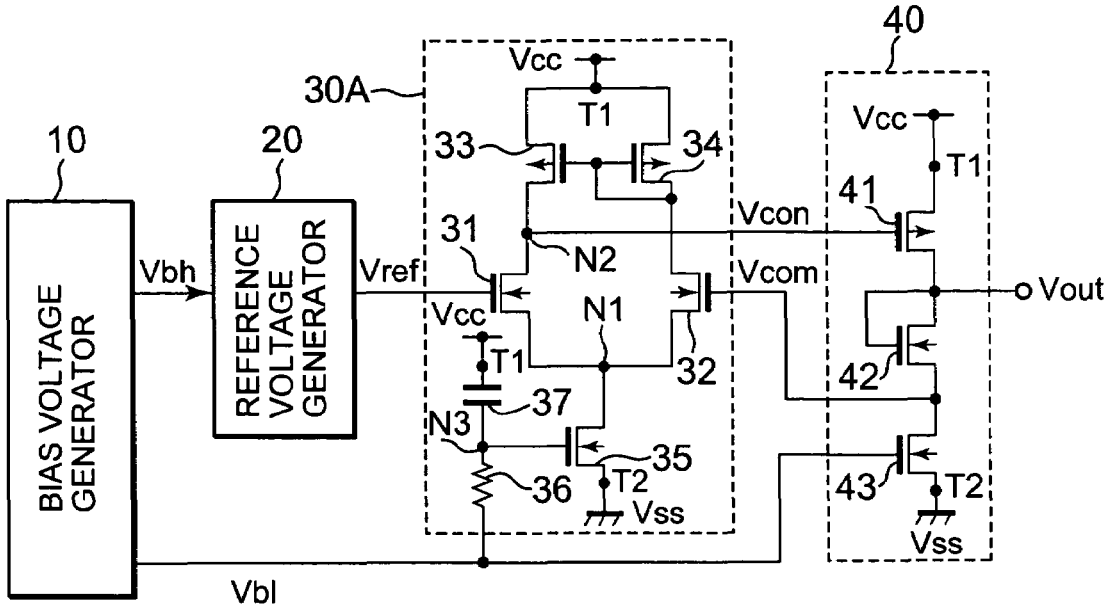
FIG. 6 is a circuit diagram for describing a voltage regulator according to a third preferred embodiment of the present invention.

FIG. 6 is a circuit diagram for describing a voltage regulator which outputs a predetermined direct-current voltage according to a third preferred embodiment of the present invention. The voltage regulator according to the third preferred embodiment has a differential amplifier 30A which is different than the differential amplifier 30 in the first preferred embodiment. Also, the bias voltage generator 10, the reference voltage generator 20 and the output circuit 40 according to the third preferred embodiment respectively have the same configurations as those according to the first preferred embodiment.

The differential amplifier 30A has the NMOS transistors 31 and 32, the PMOS transistors 33 and 34 and the constant-current circuit which includes the NMOS transistor 35 as well as the differential amplifier 30 according to the first preferred embodiment. Furthermore, the differential amplifier 30A has a resistance circuit 36 coupled between the bias voltage generator 10 and the gate electrode of the NMOS transistor 35 and has a capacitor 37 coupled between the first electrical source terminal T1 and the gate electrode of the NMOS transistor 35. That is, the resistance circuit 36 and the capacitor 37 are coupled in series between the first electrical source terminal T1 and the bias voltage generator 10, and the gate electrode of the NMOS transistor 35 is coupled to a third node N3 between the resistance circuit 36 and the capacitor 37. The gate electrode of the NMOS transistor 35 receives the low bias voltage Vbl through the resistance circuit 36.

Figure 7:
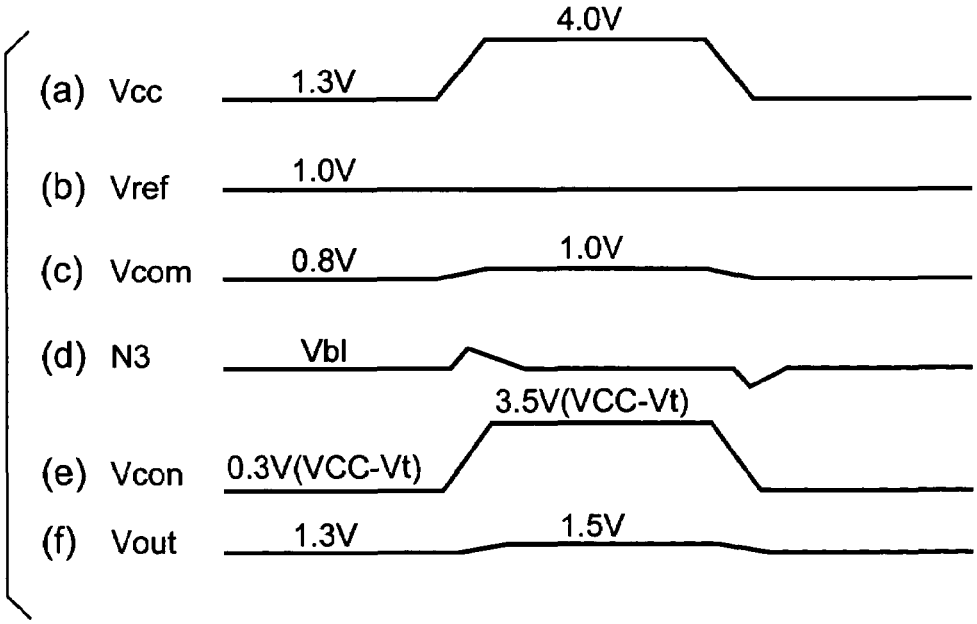
FIGS. 7(*a*) through 7(*f*) are signal waveform diagrams for describing the operation of the voltage regulator in FIG. 6.

The operation of the voltage regulator according to the third preferred embodiment of the present invention is described below. FIGS. 7(*a*) through 7(*f*) are signal waveform diagrams for describing the operation of the voltage regulator in FIG. 6. FIG. 7(*a*) represents a waveform of the power supply voltage Vcc, FIG. 7(*b*) represents a waveform of the reference voltage Vref, FIG. 7(*c*) represents a waveform of the comparison voltage Vcom, FIG. 7(*d*) represents a waveform of an electrical potential on the third node N3, FIG. 7(*e*) represents a waveform of the control voltage Vcon and FIG. 7(*f*) represents a waveform of the direct-current voltage Vout.

When the power supply voltage Vcc is 1.3V and thus lower than the predetermined direct-current voltage Vout (1.5V) as shown in FIG. 7(*a*), the direct-current voltage Vout is 1.3V at a maximum as shown in FIG. 7(*f*). Therefore, as shown in FIG. 7(*c*), the comparison voltage Vcom is 0.8V as well as in the first preferred embodiment. On the other hand, the reference voltage generator 20 outputs the reference voltage Vref which is 1.0V. Therefore, the electrical potential on the second node N2, that is, the control voltage Vcon is decreased by the operation of the differential amplifier 30A, and then, the first output MOS transistor 41 of the output circuit 40 is turned ON so that the first output MOS transistor 41 is substantially shorted. In the meanwhile, the electrical potential on the third node N3 is substantially the same as the low bias voltage Vbl. Thereby, the NMOS transistor 35 of the constant-current circuit restrains a current from passing through the differential amplifier 30A as much as possible.

Then, the power supply voltage Vcc is increased from 1.3V to 4.0V with the first output MOS transistor 41 substantially shorted. Also, the electrical potential on the third node N3 is increased in accordance with the increase of the power supply voltage Vcc as shown in FIG. 7(*d*). Therefore, the NMOS transistor 35 is turned ON and allows a large current to pass through itself. As a result, the electrical potential on the second node N2, that is, the control voltage Vcon is rapidly increased by the high-speed operation of the differential amplifier 30A as shown in FIG. 7(*e*). When a difference between the control voltage Vcon and the power supply voltage Vcc becomes substantially equal to the threshold voltage Vt of the first output MOS transistor 41, the direct-current voltage Vout reaches at the predetermined voltage (1.5V) as shown in FIG. 7(*f*) and the first output MOS transistor 41 is turned substantially OFF. That is, the direct-current voltage Vout is steadied to the predetermined voltage of 1.5V with the extreme increase of the direct-current voltage Vout restrained as shown in FIG. 7(*f*). After that, the electrical potential on the third node N3 goes down to the low bias voltage Vbl in accordance with a time constant based on the resistance circuit 36 and the capacitor 37.

According to the third preferred embodiment, the differential amplifier in the voltage regulator includes the resistance circuit through which the low bias voltage is supplied to the gate electrode of the NMOS transistor which constitutes the constant-current circuit of the differential amplifier and further includes the capacitor through which the first electrical source terminal is coupled to the gate electrode of the NMOS transistor which constitutes the constant-current circuit of the differential amplifier. Therefore, when the first electrical source voltage such as the power supply voltage is extremely increased, the large current passes through the differential amplifier by the constant-current circuit which is turned ON in accordance with the increases of the low bias voltage and the first electrical source voltage. As a result, the extreme increase of the direct-current voltage can be restrained before the direct-current voltage is steadied down to the predetermined voltage while consumption current in the differential amplifier during its normal operation is restrained.

Figure 8:
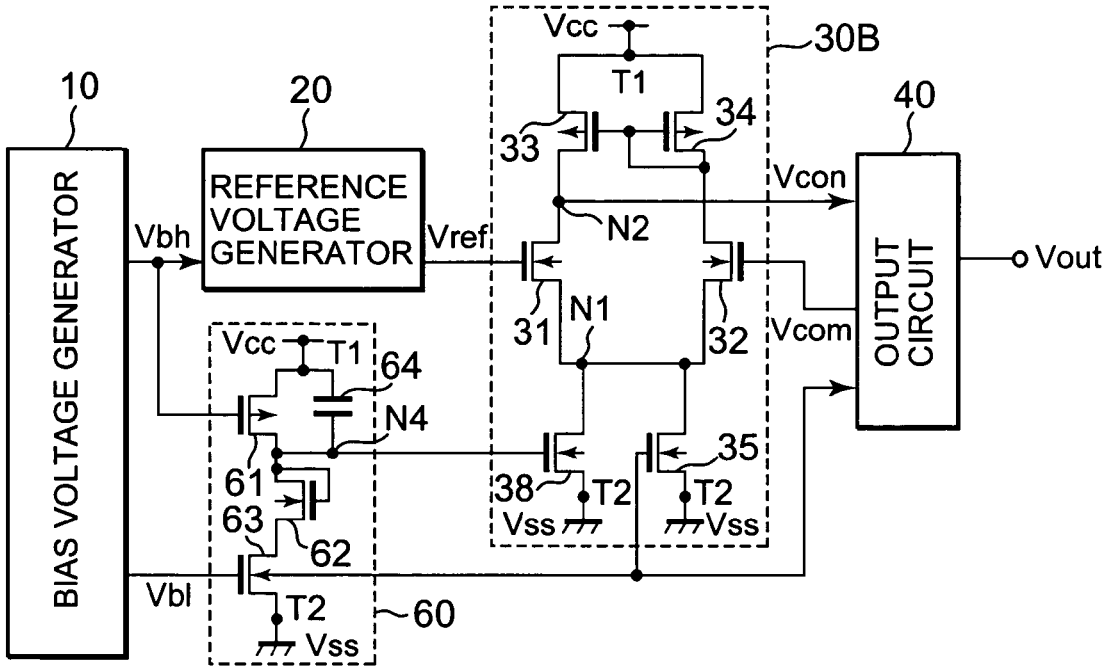
FIG. 8 is a circuit diagram for describing a voltage regulator according to a fourth preferred embodiment of the present invention.

FIG. 8 is a circuit diagram for describing a voltage regulator which outputs a predetermined direct-current voltage according to a fourth preferred embodiment of the present invention. The voltage regulator according to the fourth preferred embodiment has a differential amplifier 30B which is different than the differential amplifier 30 in the first preferred embodiment and the differential amplifier 30A in the third preferred embodiment. Furthermore, the voltage regulator according to the fourth preferred embodiment has a detecting circuit 60 coupled to the different amplifier 30B. Also, the bias voltage generator 10, the reference voltage generator 20 and the output circuit 40 according to the fourth preferred embodiment respectively have the same configurations as those according to the first preferred embodiment.

The detecting circuit 60 is coupled between the bias voltage generator 10 and the differential amplifier 30B. The detecting circuit 60 detects a variation in the power supply voltage Vcc. The detecting circuit 60 includes a PMOS transistor 61 and a capacitor 64 coupled in parallel between the first electrical source terminal T1 and a fourth node N4. The detecting circuit 60 further includes NMOS transistors 62 and 63 coupled between the fourth node N4 and the second electrical source terminal T2. The PMOS transistor 61 constitutes a first resistance circuit (a first constant-current circuit), and the NMOS transistor 63 constitutes a second resistance circuit (a second constant-current circuit). The NMOS transistor 62 is diode-connected and constitutes a constant-voltage circuit. The PMOS transistor 61 has a gate electrode coupled to the bias voltage generator 10 so as to receive the high bias voltage Vbh. The NMOS transistor 63 has a gate electrode coupled to the bias voltage generator 10 so as to receive the low bias voltage Vbl.

The differential amplifier 30B has the NMOS transistors 31 and 32, the PMOS transistors 33 and 34 and the constant-current circuit which includes the NMOS transistor 35 as well as the differential amplifier 30 according to the first preferred embodiment. Furthermore, the differential amplifier 30B has an NMOS transistor 38 coupled between the first node N1 and the second electrical source terminal T2. The NMOS transistor 38 constitutes an operation current generating circuit for the differential amplifier 30B. The NMOS transistor 38 has a gate electrode coupled to the fourth node N4 of the detecting circuit 60.

Figure 9:
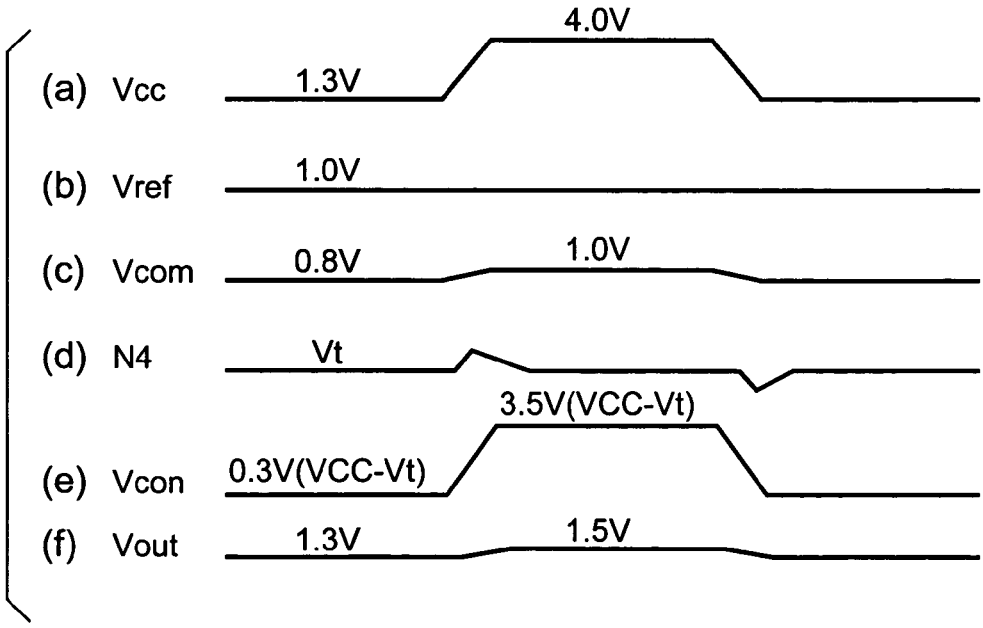
FIGS. 9(*a*) through 9(*f*) are signal waveform diagrams for describing the operation of the voltage regulator in FIG. 8.

The operation of the voltage regulator according to the fourth preferred embodiment of the present invention is described below. FIGS. 9(*a*) through 9(*f*) are signal waveform diagrams for describing the operation of the voltage regulator in FIG. 8. FIG. 9(*a*) represents a waveform of the power supply voltage Vcc, FIG. 9(*b*) represents a waveform of the reference voltage Vref, FIG. 9(*c*) represents a waveform of the comparison voltage Vcom, FIG. 9(*d*) represents a waveform of an electrical potential on the fourth node N4, FIG. 9(*e*) represents a waveform of the control voltage Vcon and FIG. 9(*f*) represents a waveform of the direct-current voltage Vout.

When the power supply voltage Vcc is 1.3V and thus lower than the predetermined direct-current voltage Vout (1.5V) as shown in FIG. 9(*a*), the electrical potential on the fourth node N4 is equal to a threshold voltage Vt of the NMOS transistor 62 as shown in FIG. 9(*d*). During this time, the NMOS transistor 38 does not allow a current to pass through itself. Also, the direct-current voltage Vout is 1.3V at a maximum as shown in FIG. 9(*f*). Therefore, as shown in FIG. 9(*c*), the comparison voltage Vcom is 0.8V as well as in the third preferred embodiment. On the other hand, the reference voltage generator 20 outputs the reference voltage Vref which is 1.0V. Therefore, the control voltage Vcon is decreased by the operation of the differential amplifier 30B, and then, the first output MOS transistor 41 of the output circuit 40 is turned ON so that the first output MOS transistor 41 is substantially shorted.

Then, the power supply voltage Vcc is increased from 1.3V to 4.0V with the first output MOS transistor 41 substantially shorted. The electrical potential on the fourth node N4 is increased through the capacitor 64 of the detecting circuit 60 in accordance with the increase of the power supply voltage Vcc as shown in FIG. 9(*d*). Therefore, the NMOS transistor 38 is turned ON, and thus, the current passing through the differential amplifier 30B is increased. As a result, the control voltage Vcon is rapidly increased by the high-speed operation of the differential amplifier 30B as shown in FIG. 9(*e*). When a difference between the control voltage Vcon and the power supply voltage Vcc becomes substantially equal to the threshold voltage Vt of the first output MOS transistor 41, the direct-current voltage Vout reaches at the predetermined voltage (1.5V) as shown in FIG. 9(*f*) and the first output MOS transistor 41 is turned substantially OFF. That is, the direct-current voltage Vout is steadied to the predetermined voltage of 1.5V with the extreme increase of the direct-current voltage Vout restrained. After that, the electrical potential on the fourth node N4 goes down to the threshold voltage Vt of the NMOS transistor 62 because of the current passing through the NMOS transistor 63.

In addition, the threshold voltage of the NMOS transistor 62 in the detecting circuit 60 may be lower than that of the NMOS transistor 38 in the differential amplifier 30B. On such an occasion like this, the electrical potential on the fourth node N4 is decreased during the normal operation of the voltage regulator by the difference between the threshold voltages of the NMOS transistor 62 and the NMOS transistor 38. That is, the NMOS transistor 38 can be steadily turned OFF during the normal operation of the voltage regulator. Therefore, a small variation of the power supply voltage Vcc does not allow the current to pass through the NMOS transistor 38 of the operation current generating circuit. As a result, the voltage regulator can stably operate even if the power supply voltage Vcc varies due to some small noises.

According to the fourth preferred embodiment, the voltage regulator includes the detecting circuit which detects the variation in the first electrical source voltage such as the power supply voltage and further includes the operation current generating circuit which is controlled by the detected variation in the first electrical source voltage. Therefore, when the first electrical source voltage is extremely increased, the large current passes through the differential amplifier by the operation current generating circuit which is turned ON responsive to the detected variation in the first electrical source voltage. As a result, the extreme increase of the direct-current voltage can be restrained before the direct-current voltage is steadied to the predetermined voltage. Also, since the voltage regulator includes the operation current generating circuit besides the constant-current circuit in the differential amplifier, the predetermined direct-current voltage Vout can be stably generated not only when the first electrical source voltage is extremely increased but also when the first electrical source voltage is extremely decreased.

Figure 10:
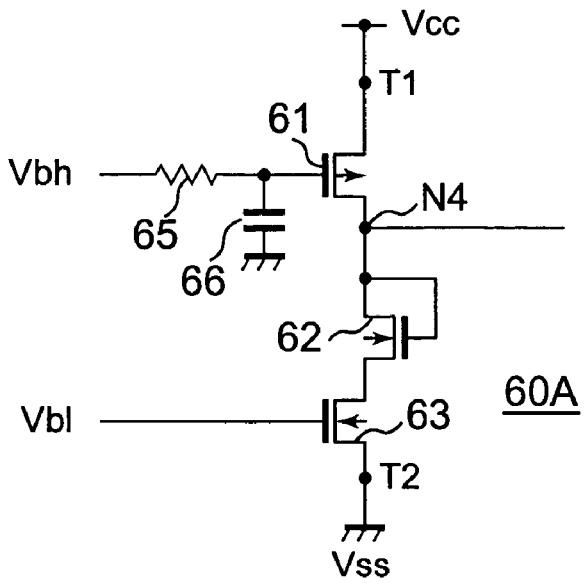
FIG. 10 is a circuit diagram for describing a detecting circuit according to a fifth preferred embodiment of the present invention.

FIG. 10 is a circuit diagram for describing a detecting circuit 60A according to a fifth preferred embodiment of the present invention. In the voltage regulator according to the fifth preferred embodiment, the detecting circuit 60A is used instead of the detecting circuit 60 in the voltage regulator according to fourth preferred embodiment.

The detecting circuit 60A has the PMOS transistor 61 and the NMOS transistors 62 and 63 as well as the detecting circuit 60 in the fourth preferred embodiment. The detecting circuit 60A also has a delay circuit coupled between the gate electrode of the PMOS transistor 61 and the bias voltage generator 10. The delay circuit includes a resistance element 65 coupled between the gate electrode of the PMOS transistor 61 and the bias voltage generator 10 and a capacitance element 66 coupled between the gate electrode of the PMOS transistor 61 and the second electrical source terminal T2.

The operation of the voltage regulator according to the fifth preferred embodiment of the present invention is described below.

When the power supply voltage Vcc is 1.3V and thus lower than the predetermined direct-current voltage Vout (1.5V), the high bias voltage Vbh is supplied to the gate electrode of the PMOS transistor 61 and the electrical potential on the fourth node N4 is equal to the threshold voltage Vt of the NMOS transistor 62. Then, as described in the fourth preferred embodiment, the first output MOS transistor 41 of the output circuit 40 is turned ON so that the first output MOS transistor 41 is substantially shorted.

Then, the power supply voltage Vcc is increased from 1.3V to 4.0V with the first output MOS transistor 41 substantially shorted. During this time, the high bias voltage Vbh is increased responsive to the increase of the power supply voltage Vcc. However, the high bias voltage Vbh is supplied to the gate electrode of the PMOS transistor 61 behind by the delay circuit. That is, the electrical potential on the gate electrode of the PMOS transistor 61 is slowly increased by the delay circuit. Therefore, a voltage, which is larger than a difference between the power supply voltage Vcc and the high bias voltage Vbh, is applied between the gate electrode and the source electrode of the PMOS transistor 61. As a result, the PMOS transistor 61 temporarily allows a large current to pass through itself, and thus, the electrical potential on the fourth node N4 is temporarily increased. Thereby, the current passing through the differential amplifier 30B is more increased, the first output MOS transistor 41 is steadily turned OFF. Thus, as well as in the fourth preferred embodiment, the direct-current voltage Vout is steadied to the predetermined voltage of 1.5V with the extreme increase of the direct-current voltage Vout restrained. After that, the electrical potential on the fourth node N4 goes down to the threshold voltage Vt of the NMOS transistor 62 because of the current passing through the NMOS transistor 63.

According to the fifth preferred embodiment, since the detecting circuit has the delay circuit coupled between the bias voltage generator and the first resistance circuit, the electrical potential on the fourth node of the detecting circuit can be adjusted by the current passing through the first resistance circuit. Therefore, the range of the electrical potential on the fourth node which is adjusted can be greater. As a result, in the fifth preferred embodiment, the current passing through the differential amplifier can be easily adjusted, in addition to the effects realized in the fourth preferred embodiment.

Figure 11:
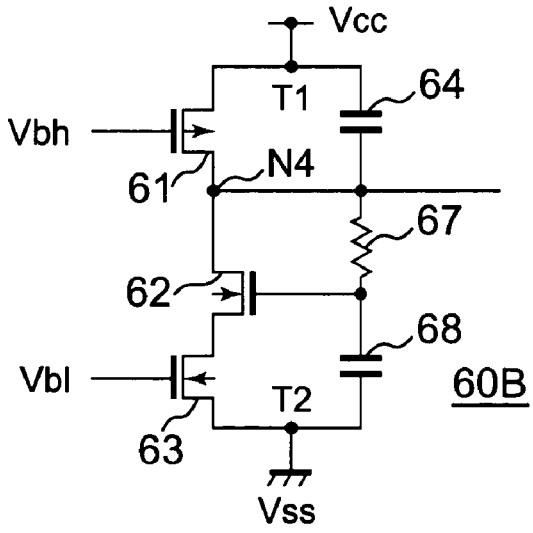
FIG. 11 is a circuit diagram for describing a detecting circuit according to a sixth preferred embodiment of the present invention.

FIG. 11 is a circuit diagram for describing a detecting circuit 60B according to a sixth preferred embodiment of the present invention. In the voltage regulator according to the sixth preferred embodiment, the detecting circuit 60B is used instead of the detecting circuit 60 in the voltage regulator according to fourth preferred embodiment.

The detecting circuit 60B has the PMOS transistor 61, the NMOS transistors 62 and 63 and the capacitor 64 as well as the detecting circuit 60 in the fourth preferred embodiment. The detecting circuit 60B also has a delay circuit coupled between the fourth node N4 and the second electrical source terminal T2. The delay circuit includes a resistance element 67 coupled between the fourth node N4 and the gate electrode of the NMOS transistor 62 and a capacitance element 68 coupled between the gate electrode of the NMOS transistor 62 and the second electrical source terminal T2.

The operation of the voltage regulator according to the sixth preferred embodiment of the present invention is described below.

When the power supply voltage Vcc is 1.3V and thus lower than the predetermined direct-current voltage Vout (1.5V), the high bias voltage Vbh is supplied to the gate electrode of the PMOS transistor 61 and the electrical potential on the fourth node N4 is equal to the threshold voltage Vt of the NMOS transistor 62. Then, as described in the fourth preferred embodiment, the first output MOS transistor 41 of the output circuit 40 is turned ON so that the first output MOS transistor 41 is substantially shorted.

Then, the power supply voltage Vcc is increased from 1.3V to 4.0V with the first output MOS transistor 41 substantially shorted. During this time, the electrical potential on the fourth node N4 is increased through the capacitor 64 of the detecting circuit 60 in accordance with the increase of the power supply voltage Vcc. On the other hand, the electrical potential on the gate electrode of the NMOS transistor 62 is slowly increased by the delay circuit. Therefore, the operation toward an ON-state with respect to the NMOS transistor 62 is delayed. That is, the time to increase the electrical potential on the fourth node N4 can be ensured longer. Thereby, the current passing through the differential amplifier 30B is more increased, the first output MOS transistor 41 is steadily turned OFF. Thus, as well as in the fourth and fifth preferred embodiments, the direct-current voltage Vout is steadied to the predetermined voltage of 1.5V with the extreme increase of the direct-current voltage Vout restrained.

Also, when the power supply voltage Vcc is decreased, the electrical potential on the gate electrode of the NMOS transistor 62 is slowly decreased by the delay circuit. Therefore, the operation toward an OFF-state with respect to the NMOS transistor 62 is delayed. As a result, during the decrease of the power supply voltage Vcc, an extra electrical charge can flow from the fourth node N4 to the second electrical source terminal T2 through the NMOS transistors 62 and 63.

According to the sixth preferred embodiment, since the detecting circuit has the delay circuit coupled between the fourth node and the second electrical source terminal and the delay circuit includes a resistance element coupled between the fourth node and the constant-voltage circuit and a capacitance element coupled between the constant-voltage circuit and the second electrical source terminal, the constant-voltage circuit can be turned ON or OFF behind the increase or decrease of the first electrical source voltage such as the power supply voltage. Therefore, the time to increase the current passing through the differential amplifier can be ensured longer. As a result, in the sixth preferred embodiment, the direct-current voltage can be stably and steadily output from the voltage regulator.

What is claimed is:

1. A voltage regulator which generates a predetermined direct-current voltage, comprising:

a first electrical source terminal which receives a first electrical source voltage;

a second electrical source terminal which receives a second electrical source voltage which is lower than the first electrical source voltage;

a reference voltage generator, coupled between the first electrical source terminal and the second electrical source terminal, that outputs a reference voltage based on the first and second electrical source voltages;

an output circuit, coupled between the first electrical source terminal and the second electrical source terminal, that generates the predetermined direct-current voltage based on the reference voltage and that generates a comparison voltage lower than the predetermined direct-current voltage;

a differential amplifier, coupled between the reference voltage generator and the output circuit, that provides a control voltage to the output circuit responsive to a difference between the reference voltage and the comparison voltage; and a voltage adjustment circuit, coupled to the reference voltage generator and the differential amplifier, that adjusts the reference voltage responsive to a variation in the first electrical source voltage, wherein the voltage adjustment circuit includes first and second adjusting MOS transistors coupled in series between the first electrical source terminal and a voltage dividing node, a third adjusting MOS transistor coupled between the voltage dividing node and the second electrical source terminal, and a fourth adjusting MOS transistor coupled between the reference voltage generator and the voltage dividing node.

2. The voltage regulator according to claim 1, wherein a ratio of a gate width to a gate length of the second adjusting MOS transistor is substantially equal to a ratio of a gate width to a gate length of the fourth adjusting MOS transistor.

3. The voltage regulator according to claim 1, wherein the voltage adjustment circuit further includes a fifth adjusting MOS transistor coupled between the voltage dividing node and the third adjusting MOS transistor, the fifth adjusting MOS transistor being controlled by the reference voltage.

4. The voltage regulator according to claim 3, wherein a withstand voltage of the fifth adjusting MOS transistor is greater than a withstand voltage of the third adjusting MOS transistor.

5. A voltage regulator which generates a predetermined direct-current voltage, comprising:

a first electrical source terminal which receives a first electrical source voltage;

a second electrical source terminal which receives a second electrical source voltage which is lower than the first electrical source voltage;

a reference voltage generator, coupled between the first electrical source terminal and the second electrical source terminal, that outputs a reference voltage based on the first and second electrical source voltages;

an output circuit, coupled between the first electrical source terminal and the second electrical source terminal, that generates the predetermined direct-current voltage based on the reference voltage and that generates a comparison voltage lower than the predetermined direct-current voltage;

a differential amplifier, coupled between the reference voltage generator and the output circuit, that provides a control voltage to the output circuit responsive to a difference between the reference voltage and the comparison voltage; and a voltage adjustment circuit, coupled to the reference voltage generator and the differential amplifier, that adjusts the reference voltage responsive to a variation in the first electrical source voltage, wherein the voltage adjustment circuit adjusts the reference voltage when the first electrical source voltage is lower than the predetermined direct-current voltage.

6. A voltage regulator which generates a predetermined direct-current voltage, comprising:

a first electrical source terminal which receives a first electrical source voltage;

a second electrical source terminal which receives a second electrical source voltage which is lower than the first electrical source voltage;

a reference voltage generator, coupled between the first electrical source terminal and the second electrical source terminal, that outputs a reference voltage based on the first and second electrical source voltages;

an output circuit, coupled between the first electrical source terminal and the second electrical source terminal, that generates the predetermined direct-current voltage based on the reference voltage and that generates a comparison voltage lower than the predetermined direct-current voltage;

a differential amplifier, coupled between the reference voltage generator and the output circuit, that provides a control voltage to the output circuit responsive to a difference between the reference voltage and the comparison voltage; and a voltage adjustment circuit, coupled to the reference voltage generator and the differential amplifier, that adjusts the reference voltage responsive to a variation in the first electrical source voltage, wherein the voltage adjustment circuit adjusts the reference voltage to be substantially equal to the comparison voltage.

7. The voltage regulator according to claim 1, further comprising:

an output terminal from which the predetermined direct-current voltage is output, wherein the output circuit comprises a first output MOS transistor coupled between the first electrical source terminal and the output terminal and second and third output MOS transistors coupled between the output terminal and the second electrical source terminal, wherein a ratio of a gate width to a gate length of the second output MOS transistor is substantially equal to a ratio of a gate width to a gate length of the first adjusting MOS transistor, and wherein a ratio of a gate width to a gate length of the third output MOS transistor is substantially equal to that in the third adjusting MOS transistor.

8. The voltage regulator according to claim 7, further comprising:

a bias voltage generator, coupled to the reference voltage generator, that provides a high bias voltage to the reference voltage generator and a low bias voltage to the voltage adjustment circuit, the differential amplifier and the output circuit.

9. The voltage regulator according to claim 8, wherein the differential amplifier includes a constant-current circuit which is controlled by the low bias voltage, and wherein the third adjusting MOS transistor of the voltage adjustment circuit and the third output MOS transistor of the output circuit are controlled by the low bias voltage.

10. The voltage regulator according to claim 7, wherein the voltage adjustment circuit adjusts the reference voltage so that a difference between the control voltage and the first electrical source voltage is substantially equal to a threshold voltage of the first output MOS transistor.

11. A voltage regulator which generates a predetermined direct-current voltage, comprising:

a first electrical source terminal which receives a first electrical source voltage;

a second electrical source terminal which receives a second electrical source voltage which is lower than the first electrical source voltage;

a reference voltage generator, coupled between the first electrical source terminal and the second electrical source terminal, that outputs a reference voltage based on the first and second electrical source voltages;

an output circuit, coupled between the first electrical source terminal and the second electrical source terminal, that generates the predetermined direct-current voltage based on the reference voltage and that generates a comparison voltage lower than the predetermined direct-current voltage;

a differential amplifier, coupled between the reference voltage generator and the output circuit, that includes a constant-current circuit and that provides a control voltage to the output circuit responsive to a difference between the reference voltage and the comparison voltage;

a bias voltage generator, coupled to the reference voltage generator, that provides a high bias voltage to the reference voltage generator and a low bias voltage to the differential amplifier and the output circuit;

a capacitor coupled between the first electrical source terminal and the constant-current circuit; and a resistance circuit coupled between the constant-current circuit and the bias voltage generator, wherein the constant-current circuit is controlled by the first electrical source voltage through the capacitor and the low bias voltage through the resistance circuit.

12. The voltage regulator according to claim 11, wherein the bias voltage generator is coupled to the first electrical source terminal through the capacitor.

13. The voltage regulator according to claim 11, wherein the constant-current circuit includes a MOS transistor, a gate electrode of the MOS transistor being coupled to the capacitor and the resistance circuit.

14. A voltage regulator which generates a predetermined direct-current voltage, comprising:

a first electrical source terminal which receives a first electrical source voltage;

a second electrical source terminal which receives a second electrical source voltage which is lower than the first electrical source voltage;

a reference voltage generator, coupled between the first electrical source terminal and the second electrical source terminal, that outputs a reference voltage based on the first and second electrical source voltages;

an output circuit, coupled between the first electrical source terminal and the second electrical source terminal, that generates the predetermined direct-current voltage based on the reference voltage and that generates a comparison voltage lower than the predetermined direct-current voltage;

a differential amplifier, coupled between the reference voltage generator and the output circuit, that includes a constant-current circuit and an operation current generating circuit which are coupled together in parallel, wherein the differential amplifier provides a control voltage to the output circuit responsive to a difference between the reference voltage and the comparison voltage; and a detecting circuit, coupled between the first electrical source terminal and the second electrical source terminal, that detects a variation in the first electrical source voltage and controls the operation current generating circuit responsive to the detected variation.

15. The voltage regulator according to claim 14, wherein the detecting circuit comprises:

a capacitor coupled between the first electrical source terminal and the operation current generating circuit; and a constant-voltage circuit coupled between the operation current generating circuit and the second electrical source terminal.

16. The voltage regulator according to claim 15, further comprising:

a bias voltage generator, coupled to the reference voltage generator, that provides a high bias voltage to the reference voltage generator and a low bias voltage to the detecting circuit, the differential amplifier and the output circuit, wherein the detecting circuit further includes a first resistance circuit coupled between the first electrical source terminal and the operation current generating circuit, the first resistance circuit being controlled by the high bias voltage, and a second resistance circuit coupled between the operation current generating circuit and the second electrical source terminal, the second resistance circuit being controlled by the low bias voltage.

17. The voltage regulator according to claim 14, further comprising:

a bias voltage generator, coupled to the reference voltage generator, that provides a high bias voltage to the reference voltage generator and a low bias voltage to the detecting circuit, the differential amplifier and the output circuit, wherein the detecting circuit includes a first resistance circuit coupled between the first electrical source terminal and the operation current generating circuit, the first resistance circuit being controlled by the high bias voltage, a constant-voltage circuit coupled between the operation current generating circuit and the second electrical source terminal, and a delay circuit, coupled between the first resistance circuit and the bias voltage generator, that includes a resistance element and a capacitance element.

18. The voltage regulator according to claim 16, further comprising:

a delay circuit coupled, between the operation current generating circuit and the constant-voltage circuit, that includes a resistance element and a capacitance element.

19. The voltage regulator according to claim 15, wherein the operation current generating circuit includes a MOS transistor, a gate electrode of the MOS transistor being coupled to the detecting circuit.

20. The voltage regulator according to claim 19, wherein the constant-voltage circuit includes a diode-connected MOS transistor.

21. The voltage regulator according to claim 20, wherein the diode-connected MOS transistor of the constant-voltage circuit has a lower threshold voltage than the MOS transistor of the operation current generating circuit.

* * * * *